US005330575A

United States Patent [19]

Poole et al.

[11] Patent Number: 5,330,575

[45] Date of Patent: Jul. 19, 1994

[54] METHOD AND APPARATUS FOR APPLICATION OF WALLPAPER PASTER

[75] Inventors: Robert N. Poole, Phoenix; Daniel L. Poole, Glendale, both of Ariz.

[73] Assignee: Blackhawk Metal Products, Inc., Phoenix, Ariz.

[21] Appl. No.: 978,254

[22] Filed: Nov. 18, 1992

[51] Int. Cl.[5] ..... B05C 1/08

[52] U.S. Cl. ..... 118/123; 118/245; 118/246; 118/261; 118/DIG. 17; 156/578

[58] Field of Search ..... 118/103, 123, 245, 246, 118/261, DIG. 17, DIG. 15; 492/27; 156/578

[56] References Cited

U.S. PATENT DOCUMENTS

| | | | |
|---|---|---|---|
| 90,081 | 5/1869 | Cline . | |
| 128,193 | 6/1872 | Weiss . | |
| 148,129 | 3/1874 | Miner . | |
| 225,860 | 3/1880 | Pattison . | |
| 3,87,793 | 8/1888 | McAfee . | |
| 481,251 | 8/1892 | Barton . | |
| 621,595 | 3/1899 | Beal . | |
| 802,292 | 10/1905 | Howell . | |
| 903,672 | 11/1908 | Chatelain . | |
| 998,221 | 7/1911 | Wheeler | 118/261 |
| 1,084,964 | 1/1914 | Richardson . | |
| 1,140,112 | 5/1915 | Campbell . | |
| 1,162,247 | 11/1915 | Mobley . | |
| 1,317,713 | 10/1919 | Linder | 492/27 |
| 1,346,647 | 7/1920 | Germaszewski . | |
| 1,348,290 | 8/1920 | Malacos et al. . | |
| 1,354,184 | 9/1920 | Grigas . | |
| 1,403,395 | 1/1922 | Egleston . | |
| 1,413,443 | 4/1922 | Williams . | |
| 2,264,501 | 12/1941 | Beach | 118/DIG. 17 |
| 2,658,639 | 11/1953 | Goldberg . | |
| 2,660,429 | 11/1953 | Lorig | 492/27 |
| 2,662,658 | 12/1953 | Wynn . | |
| 3,960,643 | 6/1976 | Dargitz et al. | 156/390 |
| 4,210,485 | 7/1980 | Lake | 156/577 |
| 4,261,789 | 4/1981 | Spataro | 156/576 |
| 4,524,714 | 6/1985 | Hohenhovel | 118/DIG. 17 |
| 4,582,019 | 4/1986 | Barschneider | 118/DIG. 17 |
| 4,870,920 | 10/1989 | Kageyama et al. | 118/102 |
| 4,908,898 | 3/1990 | Kubo | 492/27 |

FOREIGN PATENT DOCUMENTS

| | | | |
|---|---|---|---|
| 2500374 | 8/1982 | France | 118/DIG. 17 |

*Primary Examiner*—W. Gary Jones
*Assistant Examiner*—Todd J. Burns
*Attorney, Agent, or Firm*—Don J. Flickinger; Lowell W. Gresham; Jordan M. Meschkow

[57] ABSTRACT

A trough having an upstream end and a downstream end removably carrying an applicator roller rotated by driving means and a scraper bar, the scraper bar upstream of and adjacent the applicator roller, and a pressure area downstream of the applicator roller. A lid hingedly coupled to the trough, carrying an outfeed roller downstream of the scraper bar for guiding wallpaper over the applicator roller and the scraper bar.

16 Claims, 3 Drawing Sheets

FIG. 1
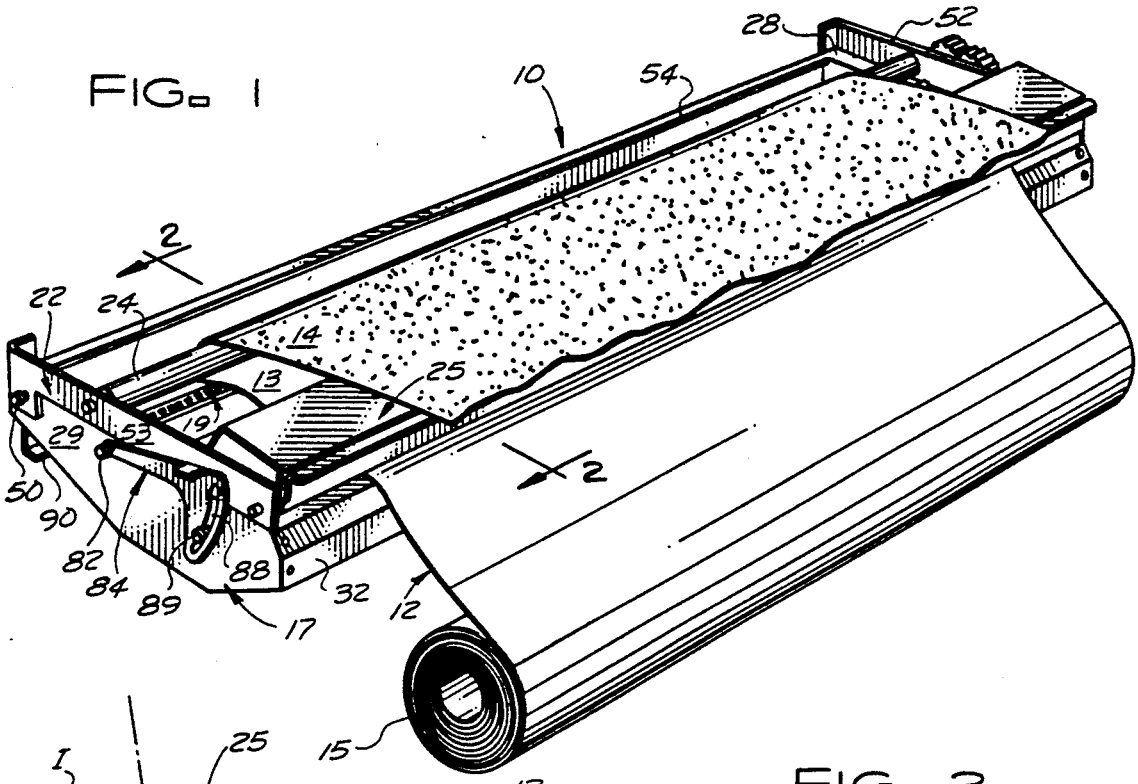
FIG. 2
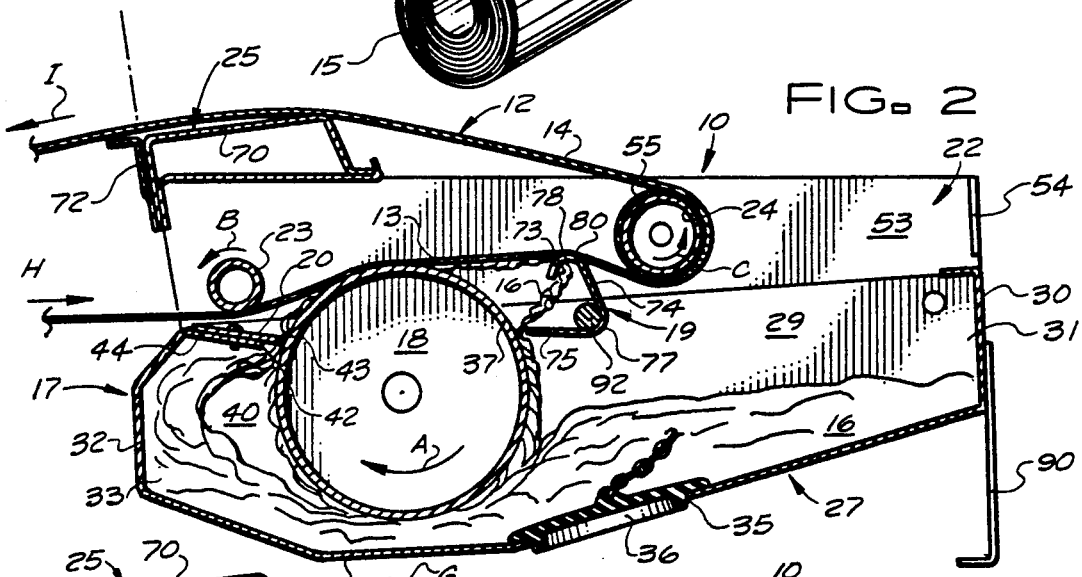
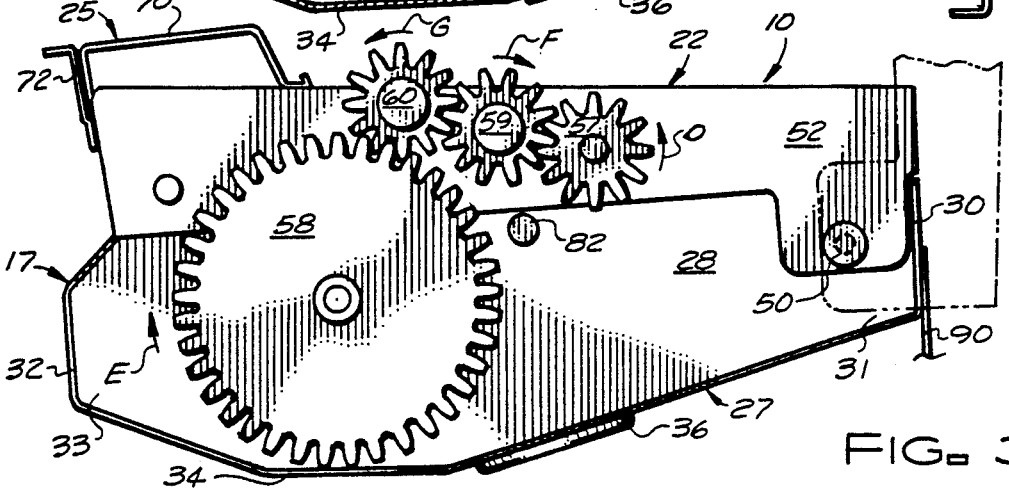
FIG. 3

METHOD AND APPARATUS FOR APPLICATION OF WALLPAPER PASTER

BACKGROUND OF THE INVENTION

1. Field of the Invention

This invention relates to devices for aiding and hanging wallpaper.

More particularly, the present invention relates to devices for applying wallpaper paste to wallpaper.

2. Prior Art

The practice of hanging paper on walls has long been observed, and has progressed through a large number of devices intended to simplify and increase the speed and efficiency of paper hanging. Hanging paper essentially consists of extracting a measured length of wallpaper from a roll. The paper has a pattern or design on a front surface and is blank on the opposing or back surface. A paste, used to affix the wallpaper to the wall, is applied to the back surface. The length of paper is then applied to the wall, paste covered side against the surface of the wall.

Different devices have been developed for the different steps in the procedure, some devices combining multiple, or even all of the steps. However, the present device is concerned with the preparation of a length of paper, that is, applying paste to the back surface of a length of wallpaper.

Traditionally, a measured length of paper is cut from a roll, placed pattern side down on a flat surface, the back surface coated with paste using a hand wielded brush. The obvious advantages to this approach is its simplicity and cost effectiveness. There are, however, major drawbacks. Specifically, the paste is very difficult to apply uniformly and of a specific thickness. This procedure is also very time consuming and can create a mess requiring further time spent in cleaning. Furthermore, a sufficiently large surface to work upon such as a table or board may not be present, and the floor may be unsuitable. There is also the possibility of unintentionally depositing paste on the design surface marring its appearance.

A further approach to applying paste to wallpaper, is the use of a paste tray, through which the paper can be pulled. This can become very messy, and uniform application of paste is very difficult. A brush is generally required to redistribute the paste. Addition of rollers for supporting the paper and applying the paste has been the answer to many of these problems. However, new problems have resulted from these innovations.

Generally, paste applicators include a tray for holding a supply of paste. An applicator roller spins through the paste, and applies it to the back surface of wallpaper as the paper passes over it. A second roller is also used, around which the wallpaper is pulled, guiding it over the applicator roller. While these devices successfully apply paste, the paste may be uneven and applied with a thickness difficult to control.

The uneven application of paste results largely from the uneven uptake of paste by the applicator roller. Wallpaper paste tends to have a viscous consistency which prevents it from flowing freely. This results in the applicator roller pushing paste to the fore and rear of the tray holding the paste, and creating a void around the applicator roller. Therefore, the applicator picks up the paste unevenly and does not deposit it uniformly on the wallpaper.

Furthermore, the amount of paste applied generally depends on the viscosity of the paste, in other words, it depends on how much paste the applicator roller can pick up. This is very difficult to control, resulting in a non-uniform layer of paste having an unknown thickness.

One of the biggest problems with paste applicators is cleaning up the apparatus after it has been used. As stated above, wallpaper paste tends to be viscous, clinging to all of the surfaces and elements to which it comes into contact. Since hanging pasted wallpaper on a wall is time consuming, many times the paste is partially dried by the time cleaning is attempted. This makes cleaning difficult, with hard to reach places around rollers and in corners almost impossible to clean.

It would be highly advantageous, therefore, to remedy the foregoing and other deficiencies inherent in the prior art.

Accordingly, it is an object of the present invention to provide a new and improved apparatus for applying paste to wallpaper.

Another object of the present invention is to provide a wallpaper paste applying apparatus which applies a uniform coating of paste to wallpaper.

And another object of the present invention is to provide an apparatus which applies paste in such a manner as to allow the thickness of the paste to be visually inspected.

Still another object of the present invention is to provide an apparatus which may be adjusted to apply a desired thickness of paste to wallpaper.

Yet another object of the present invention is to provide an apparatus which allows an-applicator roller to pick up a uniform layer of paste for application to wallpaper.

Yet still another object of the present invention is to provide an apparatus for application of paste to wallpaper which can be quickly disassembled for easy cleaning.

A further object of the present invention is to provide an apparatus which prevents voids from forming between the paste and the applicator roller to insure adequate uptake of paste by the applicator roller.

And a further object of the present invention is to provide a wallpaper paste applying apparatus which can accommodate substantially any wallpaper width.

SUMMARY OF THE INVENTION

Briefly, to achieve the desired objects of the present invention in accordance with a preferred embodiment thereof, provided is a trough having an upstream end and a downstream end, removably carrying an applicator roller intermediate the upstream end and the downstream end, and an adjustable scraper bar upstream of and adjacent the applicator roller. A pressure area is formed in the trough, downstream of the applicator roller for forcibly coating the applicator roller with paste, the depth of the paste adjustably controlled by a flow control bar. Further provided is a lid hingedly coupled to the trough, movable between an open and a closed position, and carrying an outfeed roller which is upstream of the scraper bar when lid is in the closed position. Drive means rotates the applicator roller, which applies paste to the back side of wallpaper, the scraper bar, in turn, removes an adjustable amount of paste, redepositing the removed paste on the applicator roller.

The above objects are further realized in methods of using the paste applying apparatus.

BRIEF DESCRIPTION OF THE DRAWINGS

The foregoing and further and more specific objects and advantages of the instant invention will become readily apparent to those skilled in the art from the following detailed description of the preferred embodiment thereof taken in conjunction with the drawings in which:

FIG. 1 is a perspective view of a wallpaper paste applying apparatus, constructed in accordance with the teachings of the instant invention, as it would appear being used to apply wallpaper paste to a length of wallpaper;

FIG. 2 is a cross-sectional side view of the apparatus taken along line 2—2 of FIG. 1;

FIG. 3 is a side view of the apparatus illustrated in FIG. 1;

DETAILED DESCRIPTION OF THE PREFERRED EMBODIMENT

Figure 4:
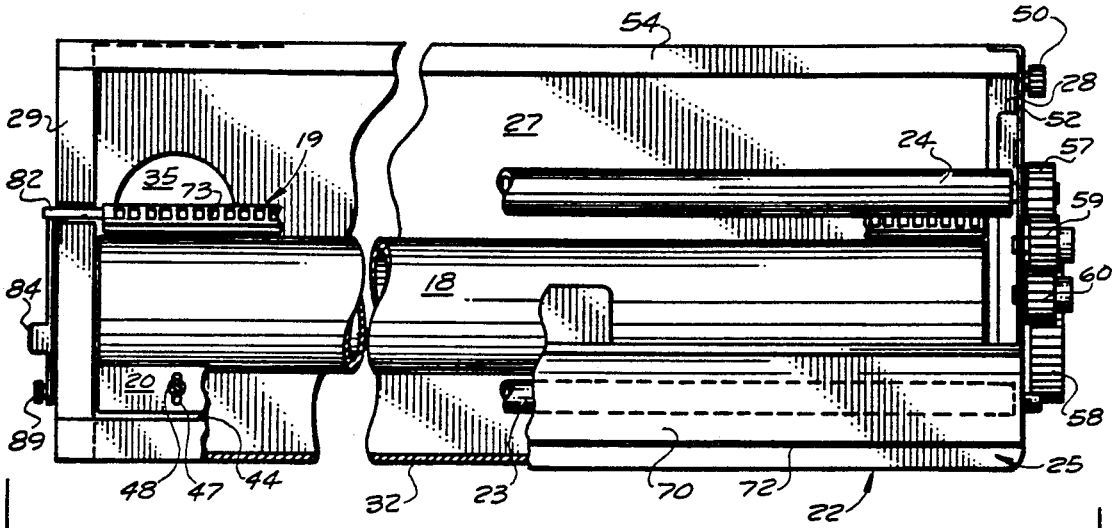
FIG. 4 is a sectional top view of the apparatus illustrated in FIG. 1.

Turning now to the drawings in which like reference characters indicate corresponding elements throughout the several views, attention is first directed to FIG. 1 which illustrates a wallpaper paste applying apparatus generally designated 10 into which wallpaper 12, having a front surface 13 and a back surface 14 is inserted. Wallpaper 12, generally supplied in the form of roll 15, is inserted, paste 16 is applied to back surface 14, and a segment of wallpaper 12, of sufficient length, is cutoff. Roll 15 is not illustrated as being supported in FIG. 1, but it will be understood that support means may be used to support roll 15. Support means can consist of a variety of well-known mechanisms, including a support roller coupled between brackets extending from wallpaper paste applying apparatus 10. It will also be understood by those skilled in the art that a pre-cut length of wallpaper 12 may also be inserted into wallpaper paste applying apparatus 10, without the need to accommodate roll 15.

With further reference to FIGS. 2–4, paste applying apparatus 10 consists of a trough 17, supporting an applicator roller 18, a scraper bar 19, and a flow control bar 20, and a lid 22 hingedly coupled to trough 17, supporting an infeed roller 23, an outfeed roller 24 and a guide assembly 25.

Trough 17 supports wallpaper paste applying apparatus 10 and holds paste 16 which applicator roller 18 picks up and applies to wallpaper 12. Trough 17 is of a width sufficient to accommodate wallpaper of substantially any desired width, and consists of a bottom 27, opposing sidewalls 28 and 29 extending upward from bottom 27, an upstream wall 30 extending upwardly from bottom 27 at an upstream end 31 of trough 17, and a downstream endwall 32 extending upwardly from bottom 27 at a downstream end 33 of trough 17. Upstream and downstream refer to the direction in which the wallpaper paste has a tendency to flow, which is from upstream end 31 to downstream end 33. To enhance the flow of paste, bottom 27 slopes downward from upstream end 31 and downstream end 33 to a substantially horizontal portion 34 located intermediate upstream end 31 and downstream end 33, but preferably closer to downstream end 33. Bottom 27 further includes a drain 35 closable by a stopper 36 through which excess paste and cleaning fluid can be removed.

Applicator roller 18 is supported between sidewalls 28 and 29 over horizontal portion 34 of bottom 27. With additional reference to FIG. 8, applicator roller 18 is a cylindrical body 37 having anodized aluminum surface for picking up paste from trough 17, with posts 38 and 39 extending axially from opposing ends of cylindrical body 37. The rotation of applicator roller 18 in the direction indicated by arrowed line A in FIG. 2 forces the paste toward downstream end 33. A pressure area 40 is created downstream of applicator roller 18 defined by applicator roller 18 and downstream endwall 32. Downstream endwall 32 curves inward to an edge 42 parallel to and adjacent the surface of applicator roller 18, with a space 43 formed therebetween. The inward curve of downstream endwall 32 may be obtained by angled portions as illustrated in FIG. 2, with an uppermost portion 44 being substantially horizontal or having a slightly downward slope towards applicator roller 18. One skilled in the art will understand that various other geometries may be employed for downstream endwall 32, such as a curved shape, the function being to form an enclosed volume (pressure are 40) which has paste forced into it along bottom 27 by the rotation of applicator roller 18 creating a pressure which forces paste out space 43 between edge 42 and applicator roller 18. This ensures application of paste to applicator roller 18.

To control the thickness of paste applied to applicator roller 18, adjustable flow control bar 20 is coupled to uppermost portion 44 of downstream endwall 32. Flow control bar 20 is a flat plate having slots 47, visible in FIGS. 4 and 5, formed therethrough for receiving screws 48. Flow control bar 20 extends between sidewalls 28 and 29 overlapping uppermost portion 44. Screws 48 fasten flow control bar 20 to uppermost portion 44 and can be loosened to adjust flow control bar 20 outward, closer to applicator roller 18 thereby reducing space 43 and removing more paste, or further away from applicator roller 18 increasing space 43 removing less paste. While controlling the amount of paste, flow control bar 20 also ensures uniformity of paste on applicator roller 18.

Lid 22 guides and supports wallpaper 12 and is hingedly coupled to trough 17 to allow wallpaper 12 to be easily inserted. Lid 22 consists of sidewalls 52 and 53, each hingedly coupled to the upstream end of sidewalls 28 and 29 respectively by thumbscrews 50. Sidewalls 52 and 53 rest upon the top of sidewalls 28 and 29 when lid 22 is closed, and extend substantially from upstream end 31 to downstream end 33 of trough 17. A brace 54 extends between and couples sidewalls 52 and 53 at their upstream ends, and guide assembly 25 extends between and couples sidewalls 52 and 53 at their downstream end, forming a frame which carries infeed roller 23 and outfeed roller 24.

Infeed roller 23 is rotatably carried between sidewalls 52 and 53 proximate the downstream end, so that when lid 22 is closed, infeed roller 23 is positioned above uppermost portion 44, downstream of applicator roller 18 and rotates in a direction indicated by arrowed line B.

Outfeed roller 24 is rotatably carried between sidewalls 52 and 53 intermediate the upstream ends and downstream ends, downstream of applicator roller 18 when lid 22 is closed. Outfeed roller 24 is covered by a friction layer 55, such as rubber, which cushions and frictionally grips front surface 13 of wallpaper 12. The friction between wallpaper 12 and outfeed roller 24 is required to ensure the rotation of outfeed roller 24 in a direction indicated by arrowed line C, when wallpaper 12 is pulled over it. The rotation of outfeed roller 24 drives applicator roller 18.

Any drive means may be used to rotate applicator roller 18, but in this preferred embodiment rotation of outfeed roller 24 drives applicator roller 18 by a coupling means, which in this embodiment is a gear assembly.

Referring specifically to FIG. 3, the gear assembly is coupled to the outside of sidewall 28 of trough 17, and sidewall 52 of lid 22. A drive gear 57 is coupled to an end of outfeed roller 24 extending through sidewall 52 of lid 22. Drive gear 57 rotates with the rotation of outfeed roller 24 in a direction indicated by arrowed line D. A driven gear 58 is coupled to post 38 of applicator roller 18, and is rotated by drive gear 57 in a direction indicated by arrowed line E. Drive gear 57 could intermesh with and directly drive driven gear 58, but there would be insufficient space between applicator roller 18 and outfeed roller 24. To obtain the proper spacing and couple drive gear 57 to driven gear 58, a pair of idler gears 59 and 60 are employed. Idler gears 59 and 60 are rotatably coupled to the outer surface of sidewall 52 of lid 22 and span the distance between drive gear 58 and driven gear 59. Idler gear 59 rotates in a direction indicated by arrowed line F, and idler gear 60 rotates in a direction indicated by arrowed line G. When lid 22 is closed, idler gears 59 and 60 couple drive gear 57 to driven gear 58. While a gear assembly is preferred, one skilled in the art would understand that a variety of other coupling means may be employed such as a belt system, specifically the use of a positive drive belt.

Figure 8:
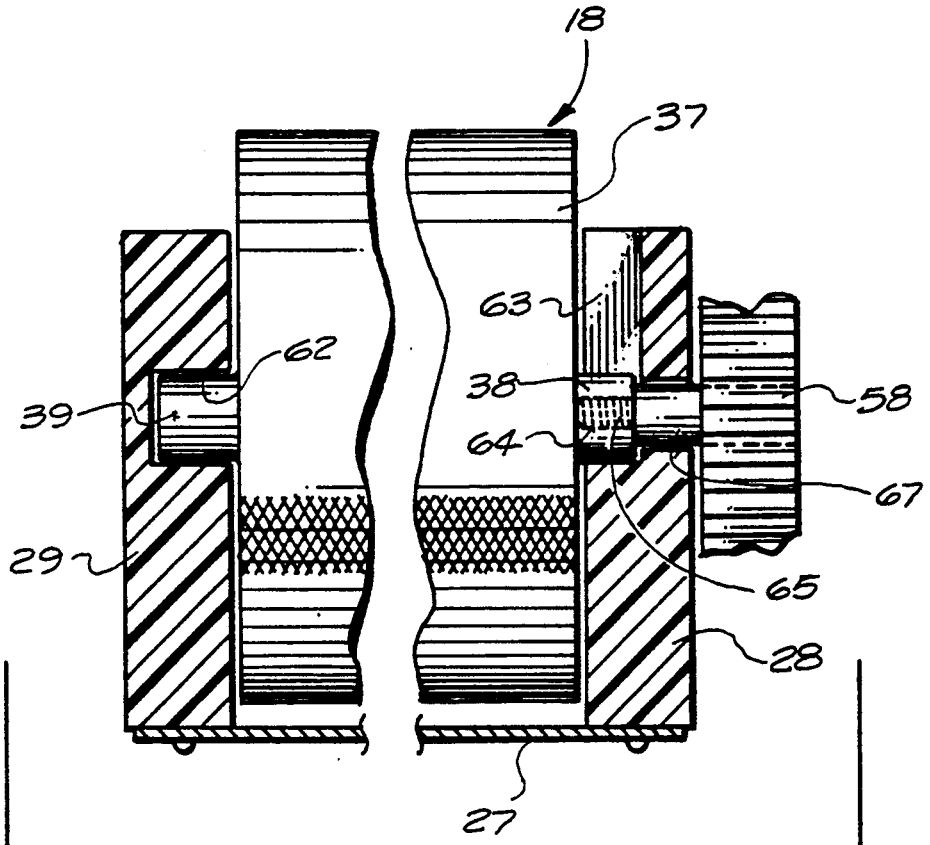
FIG. 8 is a cross-sectional end view of the apparatus, illustrating the coupling of the applicator roller to the trough.

With additional reference to FIG. 8, it can be seen that applicator roller 18 is easily removable from trough 17 for simplified cleaning. Post 39 is received by a receptacle 62, formed in sidewall 29, and post 38 is dropped into a slot 63 formed in sidewall 28. Post 38 has a threaded bore 64 extending axially therein which receives a threaded shaft 65 extending axially from driven gear 58. A bore 67 through sidewall 28 communicates with slot 63, permitting threaded shaft 65 to be journaled therethrough and threaded into threaded bore 64 of post 38, rotatably securing applicator roller 18 in place.

Referring back to FIG. 2, wallpaper 12 is inserted into wallpaper paste applying apparatus 10 by opening lid 22, placing wallpaper 12, back surface 14 downward over applicator roller 18. Lid 22 is closed, with infeed roller 23 forcing wallpaper 12 downward into firm contact with applicator roller 18. Wallpaper 12 is doubled back over outfeed roller 24 and guide assembly 25. Guide assembly 25 consists of an elevated portion 70 and a cutoff slot 72 formed therein, over which wallpaper 12 will smoothly slide. Cutoff slot 72 allows a segment of paper to be cutoff to the desired length. A blade is guided along cutoff slot 72 which aids in obtaining a straight cut.

Wallpaper 12 is fed into wallpaper paste applying apparatus 10 in a direction indicated by arrowed line H, passing over applicator roller 18. Back surface 14 is held down onto applicator roller 18 by infeed roller 23 and outfeed roller 24. As wallpaper 12 is removed from wallpaper paste applying apparatus 10 in a direction indicated by arrowed line I, outfeed roller 24 rotates, which, in turn, rotates applicator roller 18. The rotation of applicator roller 18, as discussed above, forces paste into pressure area 40 resulting in a substantial coating of paste on applicator roller 18. An even distribution and a desired depth of paste is obtained by the surface of applicator roller 18 rotating past adjustable flow control bar 20. Paste is evenly deposited on back surface 14 of wallpaper 12, since applicator roller 18 rotates at a rate proportional to the movement of wallpaper 12. Outfeed roller 24, due to its length, tends to bend slightly in the middle as wallpaper 12 is pulled in the direction of arrowed line I. This slight flexing of outfeed roller 24 tends to cause wrinkles in wallpaper 12. To compensate for this flex, a gradual thickening of outfeed roller 24 from its outer ends to its middle is employed as can be seen in FIG. 4. The medial thickening of outfeed roller 24 compensates for the flex imparted when wallpaper 12 is pulled through wall paper paste applying apparatus 10. The medial thickening, which is very slight, can be obtained by a thickening of friction layer 55. The medial thickening of outfeed roller 24 has been exaggerated in FIG. 4 for purposes of illustration.

While the amount of paste applied to wallpaper 12 can be controlled to some degree by the amount of paste applied to applicator roller 18, adjustable scraper bar 19 is carried by trough 17 adjacent applicator roller 18 on the upstream side, downstream of outfeed roller 24 to increase the control of paste application. Adjustable scraper bar 19 is an elongate member extending between sidewalls 28 and 29, over which wallpaper 12 is pulled, scraping off the paste applied by applicator roller 18. A plurality of notches 73 having adjustable depth, permit columns of paste of a height proportional to the depth of notches 73 to remain on wallpaper 12. This gives very precise control of the height of the paste, and allows quick visual inspection of the height by noting the depth of the furrows between columns of paste.

Figure 5:
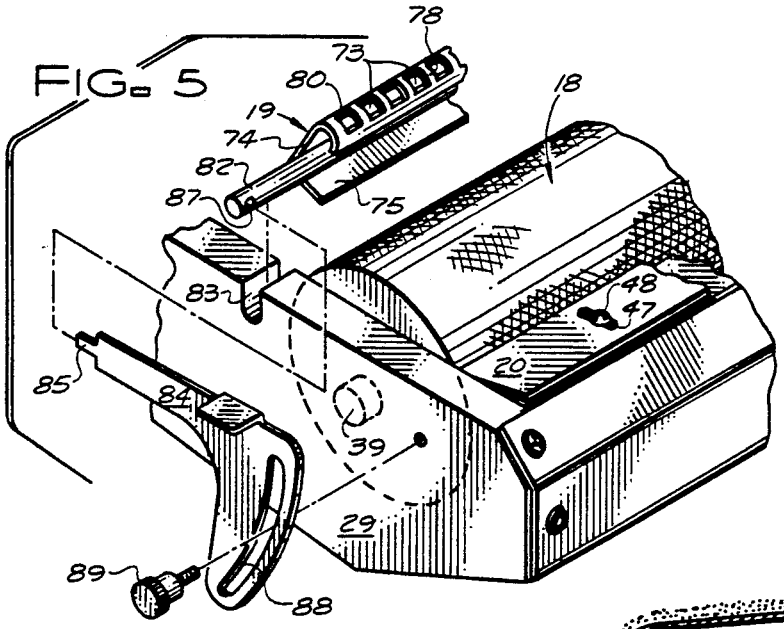
FIG. 5 is an enlarged partial view in perspective, illustrating the adjustable attachment of the scraper bar.

The adjustable depth of notches 73 is achieved in the preferred embodiment, by an angled elongate sheet having a scraper portion 74 with a hook shaped cross-section, and a catch portion 75. Scraper portion 74 and catch portion 75 are joined at an angle 77 extending the length of the elongate sheet of material. Scraper portion 74 has an apex 78 extending longitudinally therealong, with apex 78 in an upward direction, positioned to contact back surface 14 of wallpaper 12. The plurality of notches 73 are formed along apex 78 of scraper portion 74, each of notches 73 having an upstream edge 80, with the effective depth of each notch 73 being the vertical distance between upstream edge 80 and apex 78. With further reference to FIGS. 4 and 5, adjustable scraper bar 19 includes posts 82 coupled to the inside of angle 77 at both ends of the elongate sheet. Posts 82 are removably received in notches 83 formed in sidewalls 28 and 29. Adjustable scraper bar 19 is pivotally carried by trough 17, pivoting about the axis of posts 82. Scraper bar 19 is adjustably retained in a desired orientation by a lever 84 having a reduced end 85 received in a bore 87 formed in posts 82. Lever 84 has an arcuate slot 88 formed in the end opposite reduced end 85 through which a thumb screw 89 extends, securing lever 84 to sidewall 29. To adjust scraper bar 19, thumb screw 89 is loosened allowing lever 84 to slide up or down, pivoting scraper bar 19. It will be understood by those skilled in the art that while a single lever 84 is illustrated in FIG. 5, a second lever, a mirror image of the one illustrated, may be used on the opposing side. This would prevent twisting of scraper bar 19. It will also be understood that a single lever may also be used.

Figure 6:
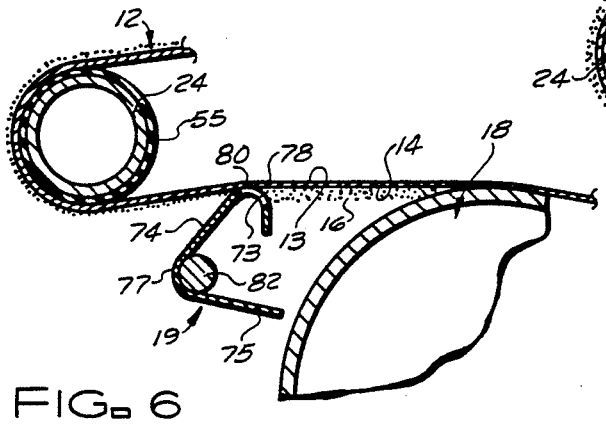
FIG. 6 is a partial cross-sectional side view illustrating the orientation of the scraper bar.
Figure 7:
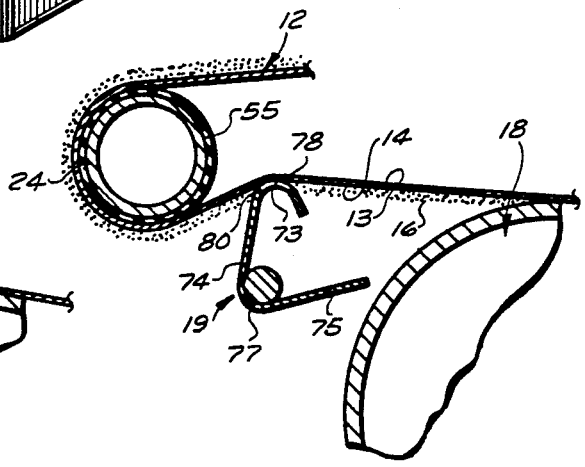
FIG. 7 is a partial cross-sectional side view illustrating an alternate orientation of the scraper.

Referring now to FIGS. 6 and 7, extreme orientations of adjustable scraper bar 19 are illustrated. FIG. 6 illustrates the forward rotation of adjustable scraper bar 19, removing the majority of the paste 16. In this forward rotated orientation, wallpaper 12 slides over apex 78, scraping off paste 16. The angle brings upstream edge 80 of notches 73 upward, effectively reducing the depth of notches 73 from the highest point of apex 78 to upstream edge 80. FIG. 7 illustrates an orientation allowing the maximum of paste 16 to remain on wallpaper 12. In this orientation, apex 78 is substantially vertical, with the vertical distance between the apex 78 and upstream edge 80 being at the maximum. Removed paste 16 drops downward as illustrated in FIG. 2 and is caught by catch portion 75. Catch portion 75 directs scraped off paste back on to applicator roller 18 further ensuring sufficient deposit of paste on applicator roller 18.

The adjustable depth of the notches can also be obtained by rotating a bar having a plurality of notches formed in its upper surface. With the notches substantially vertical, the maximum paste is allowed to remain. As the bar is rotated off vertical, increasingly more paste is scraped off. This is similar to that illustrated in FIGS. 6 and 7 of the preferred embodiment. An additional means for removing paste would be to place a bar or strip behind the bar with notches, raising it to reduce the effective depth and lowering it to increase the effective depth of the notches.

Trough 17 is maintained in its proper orientation, that is, so that horizontal portion 34 of bottom 27 remains horizontal by supports 90 extending downward from upstream endwall 30, to a level substantially even with horizontal portion 34, supporting the sloped portion of bottom 27.

Disclosed is an effective paste applying apparatus 10 which can be easily disassembled by pivoting lid 22 upward or entirely removing it by removing thumb screws 50 pivotally attaching sidewalls 52 and 53 to sidewalls 28 and 29. Trough 17 and elements carried therein are then readily accessible for cleaning. Lid 22 and elements carried thereby require little cleaning, since paste is not deposited on it. Small amounts of paste which may be deposited on it are easily wiped away. Trough 17 is easily cleaned by removing stopper 36 allowing paste to exit trough 17 through drain 35. Scraper bar 19 is easily removed by removing thumb screws 89 and lever 84. Applicator roller 18 is easily removed by unthreading driven gear 58 therefrom, then removing applicator roller 18. The easy disassembly allows the elements which come in contact with the paste to be separately cleaned, and also remove any obstructions from trough 17 to simplify its cleaning.

Various changes and modifications to the embodiment herein chosen for purposes of illustration will readily occur to those skilled in the art. To the extent that such modifications and variations do not depart from the spirit of the invention, they are intended to be included within the scope thereof which is assessed only by a fair interpretation of the following claims.

Having fully described the invention in such clear and concise terms as to enable those skilled in the art to understand and practice the same, the invention claimed is:

1. A wallpaper paste applying apparatus for applying paste to a back surface of wallpaper comprising;

a trough having an upstream end and a downstream end;

an applicator roller removably carried by said trough;

an adjustable scraper bar removably carried by said trough upstream of and adjacent to said application roller, said adjustable scraper bar including an elongate member extending between opposing sidewalls of said trough, said elongate member having a scraper portion with a hook shaped cross-section, said scraper portion having an apex extending longitudinally therealong positioned in an upward direction to contact said wallpaper, and a plurality of notches having an adjustable depth formed along said apex, said notches having an upstream edge, and a depth being the vertical distance between said apex and said upstream edge said depth adjustable by tilting said elongate member, thereby positioning said upstream edge to remove a predetermined level of paste from said wallpaper;

drive means for driving said applicator roller;

a lid removably and hingedly coupled to said trough for movement between an open position and a closed position; and an outfeed roller carried by said lid, positioned upstream of said adjustable scraper bar in the closed position.

2. A wallpaper paste applying apparatus as claimed in claim 1 wherein said trough further includes a pressure area downstream of said applicator roller for receiving a build-up of paste during operation, said build-up closing voids formed between said applicator roller and said paste, and contacting said applicator roller.

3. A wallpaper paste applying apparatus as claimed in claim 2 wherein said trough further includes:

a bottom having a portion sloping downward from said upstream end to a substantially horizontal portion;

opposing sidewalls extending upward from said bottom;

an upstream endwall extending upward from said bottom at said upstream end;

said applicator roller positioned adjacent said bottom proximate said downstream end; and a downstream endwall extending upward from said bottom at said downstream end, closely following the contours of said applicator roller.

4. A wallpaper paste applying apparatus as claimed in claim 3 wherein said pressure area is defined by said applicator roller and said downstream endwall, said downstream endwall constructed to closely follow the curve of said applicator roller and having an uppermost portion with an edge angled inward parallel to said applicator roller so as to form a space therebetween.

5. A wallpaper paste applying apparatus as claimed in claim 4 further comprising a flow control bar and means for adjustably coupling said flow control bar to said uppermost portion for varying said space.

6. A wallpaper paste applying apparatus as claimed in claim 5 wherein said adjustable coupling means includes slots formed in said flow control bar for receiving screws which extend through said slots into said uppermost portion.

7. A wallpaper paste applying apparatus as claimed in claim 3 wherein said drive means includes:

a drive gear coupled to said outfeed roller;

a driven gear coupled to said applicator roller; and coupling means for coupling said drive gear to said driven gear.

8. A wallpaper paste applying apparatus as claimed in claim 7 wherein said coupling means includes an idler gear carried by said lid, coupling said drive gear to said driven gear in the closed position.

9. A wallpaper paste applying apparatus as claimed in claim 7 wherein said applicator roller has a first post and a second post extending from opposing ends thereof, said first post rotatably and removably received by one of said sidewalls, and said second post removably received by the other of said sidewalls and rotatably secured thereto by said driven gear.

10. A wallpaper paste applying apparatus as claimed in claim 1 wherein said adjustable scraper bar further includes a catch portion extending from said scraper portion, which directs paste scraped from said wallpaper by said scraper portion directly onto said applicator roller.

11. A wallpaper paste applying apparatus as claimed in claim 1 wherein said outfeed roller has a gradual medial thickening to compensate for flex imparted thereto.

12. A wallpaper paste applying apparatus for applying paste to a back surface of wall paper comprising:

a trough having an upstream end, a downstream end, a bottom having a portion sloping downward from said upstream end to a substantially horizontal portion, opposing sidewalls extending upward from said bottom, an upstream endwall extending upward from said bottom at said upstream end, and a downstream endwall extending upward from said bottom at said downstream end;

an applicator roller removably carried by said trough, positioned adjacent said bottom proximate said downstream end; and a pressure area downstream of said applicator roller, for receiving build-up of paste during operation, said build-up closing voids formed between said applicator roller and said paste, and contacting said applicator roller, said pressure area is defined by said applicator roller and said downstream endwall, said downstream endwall constructed to closely follow the curve of said applicator roller and having an uppermost portion with an edge angled inward parallel to said applicator roller so as to form a space therebetween.

13. A wallpaper paste applying apparatus as claimed in claim 12 further comprising a flow control bar and means for adjustably coupling said flow control bar to said uppermost portion for varying said space.

14. A wallpaper paste applying apparatus as claimed in claim 13 wherein said adjustable coupling means includes slots formed in said flow control bar for receiving screws which extend through said slots into said uppermost portion.

15. A wallpaper paste applying apparatus for applying paste to a back surface of wallpaper comprising:

a trough having an upstream end and a downstream end;

an applicator roller removably carried by said trough; and a scraper bar carried by said trough upstream of said applicator roller, said scraper bar including an elongate member extending between opposing sidewalls of said trough, said elongate member having a scraper portion with a hook shaped cross-section, said scraper portion having an apex extending longitudinally therealong positioned in an upward direction to contact said wallpaper, and a plurality of notches having an adjustable depth formed along said apex, said notches having an upstream edge, and a depth being the vertical distance between said apex and said upstream edge said depth adjustable by tilting said elongate member, thereby positioning said upstream edge to remove a predetermined level of paste from said wallpaper.

16. A wallpaper paste applying apparatus as claimed in claim 13 wherein said adjustable scraper bar further includes a catch portion extending from said scraper portion, which directs paste scraped from said wallpaper by said scraper portion onto said applicator roller.

* * * * *

UNITED STATES PATENT AND TRADEMARK OFFICE

CERTIFICATE OF CORRECTION

PATENT NO. : 5,330,575

DATED : 19 July 1994

INVENTOR(S) : Robert N. Poole, Daniel L. Poole

It is certified that error appears in the above-identified patent and that said Letters Patent is hereby corrected as shown below:

Column 8, Line 12, (Claim 1) please replace "application" with --applicator-- after the word "said".

Signed and Sealed this

Twenty-seventh Day of September, 1994

*Attest:*

*Attesting Officer*

Bruce Lehman

BRUCE LEHMAN

*Commissioner of Patents and Trademarks*